US010240287B2

(12) United States Patent
Kettunen et al.

(10) Patent No.: US 10,240,287 B2
(45) Date of Patent: Mar. 26, 2019

(54) HEATING OF HYDRAULIC DIGESTERS

(71) Applicant: ANDRITZ OY, Helsinki (FI)

(72) Inventors: Auvo Kettunen, Kotka (FI); Pasi Heinämäki, Kotka (FI); Kari Peltonen, Kotka (FI); Hannu Råmark, Kotka (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 15/509,959

(22) PCT Filed: Sep. 10, 2015

(86) PCT No.: PCT/FI2015/050592
§ 371 (c)(1),
(2) Date: Mar. 9, 2017

(87) PCT Pub. No.: WO2016/038251
PCT Pub. Date: Mar. 17, 2016

(65) Prior Publication Data

US 2017/0260693 A1 Sep. 14, 2017

(30) Foreign Application Priority Data

Sep. 12, 2014 (FI) ..... 20145803

(51) Int. Cl.
*D21C 3/24* (2006.01)
*D21C 7/06* (2006.01)
*D21C 7/10* (2006.01)

(52) U.S. Cl.
CPC ..... *D21C 7/10* (2013.01); *D21C 3/24* (2013.01); *D21C 7/06* (2013.01)

(58) Field of Classification Search
CPC ... D21C 3/24; D21C 7/06; D21C 7/14; D21C 7/10
See application file for complete search history.

(56) References Cited

U.S. PATENT DOCUMENTS 1,802,266 A * 4/1931 Morterud ..... D21C 7/14 162/249
2,001,022 A * 5/1935 How ..... D21C 7/10 162/238

(Continued)

FOREIGN PATENT DOCUMENTS

WO WO 94/23120 10/1994
WO WO 98/35091 8/1998

(Continued)

OTHER PUBLICATIONS

International Search Report for PCT/FI2015/050592 dated Dec. 22, 2015, 4 pages.

(Continued)

*Primary Examiner* — Jose A Fortuna
(74) *Attorney, Agent, or Firm* — Nixon & Vanderhye P.C.

(57) ABSTRACT

A method and system for heating a hydraulic digester, such as a single-vessel hydraulic digester, which has a top separator, a level of chips and a liquid phase above the level of chips. The method includes: a. entraining chips in liquor to produce a slurry having a first temperature, b. feeding the slurry of chips to the digester through the top separator, c. supplying direct steam to the liquid phase between the level of chips and the top separator to heat the slurry to a second temperature for the impregnation stage, wherein the steam is fed by using at least one steam injector having a plurality of steam discharge openings; and d. heating the slurry to a third temperature and cooking the chips in a cooking zone, and withdrawing the cooked pulp from the bottom of the digester.

6 Claims, 4 Drawing Sheets

(56) References Cited

U.S. PATENT DOCUMENTS

| | | | | |
|---|---|---|---|---|
| 2,914,223 | A * | 11/1959 | Richter | D21C 7/06 222/219 |
| 3,258,390 | A * | 6/1966 | Tomlinson, II | D21C 1/10 162/17 |
| 6,086,717 | A | 7/2000 | Snekkenes et al. | |
| 6,171,494 | B1 | 1/2001 | Snekkenes et al. | |
| 6,497,791 | B1 | 12/2002 | Baker | |
| 2004/0226670 | A1 | 11/2004 | Vogel et al. | |
| 2011/0120663 | A1 | 5/2011 | Engstrom et al. | |
| 2017/0260693 | A1* | 9/2017 | Kettunen | D21C 7/06 |

FOREIGN PATENT DOCUMENTS

| | | |
|---|---|---|
| WO | WO 2005/106111 | 11/2005 |
| WO | WO 2012/134358 | 10/2012 |

OTHER PUBLICATIONS

Written Opinion of the ISA for PCT/FI2015/050592 dated Dec. 22, 2015, 5 pages.

* cited by examiner (PRIOR ART)

(PRIOR ART)

HEATING OF HYDRAULIC DIGESTERS

RELATED APPLICATIONS

This application is the U.S. national phase of International Application No. PCT/FI2015/050592 filed Sep. 10, 2015, which designated the U.S. and claims priority to Finnish Patent Application FI 20145803 filed Sep. 12, 2014, the entire contents of these applications are incorporated by reference.

BACKGROUND OF INVENTION

This invention relates to a method of producing chemical pulp in an impregnation stage and a cooking stage, using a hydraulic digester, especially a single-vessel hydraulic digester. The invention relates also to a digester system and to a steam injector.

Continuous digesters are widely used to produce chemical pulp. There are essentially two main types of continuous digesters: the hydraulic digester and the vapor-phase digester. A hydraulic digester is a pressure-resistant vessel which is completely filled with comminuted cellulosic fibrous material and liquid; any introduction or removal of liquid from the vessel affects the typically super-atmospheric pressure within the vessel. A vapor-phase digester is not completely filled with liquid but includes a section at the top containing super-atmospheric steam. Since this gas zone is compressible compared to the liquid zone below it, the pressure within a vapor-phase digester is typically determined by the pressure of the gas present at the top of the digester. The reaction of pulping chemicals with comminuted cellulosic fibrous material to produce a chemical pulp requires temperatures ranging between 140-180° C. Since at atmospheric conditions the aqueous chemicals used to treat the material would boil at such temperatures, commercial chemical pulping is typically performed in a pressure-resistant vessel under pressures of at least about 5 bars gauge.

One principal distinction between the method of operation of these two types of digesters is the way the contents of the digesters are heated to the desired 140-180° C. In the vapor-phase digester, the chips are typically heated by exposing the chips to steam. This steam heating is typically performed as the chips are introduced to the steam-filled zone at the top of the digester. In the hydraulic digester, the slurry of comminuted cellulosic fibrous material, typically wood chips, and cooking liquor is typically heated by means of heated liquid circulations, i e. one or more recirculation loops. Liquid is typically removed from the digester, for example, by using an annular screen assembly and pump, heated with steam by means of an indirect heat ex-changer, and re-introduced to the material in the vessel using a centrally located pipe. It has not been possible to add direct steam to the top of the hydraulic digester because the steam condensing into liquor would have caused hammering and in the worse it could have caused cracks to the digester shell. In some cases a steam line has been connected to the top of the hydraulic digester, but purpose of this steam has been to push the digester empty of chips and liquor before the shutdown, not to use it for heating during normal operation.

Furthermore, chips are introduced to the digesters using different mechanical devices. Wood chips, or other comminuted cellulosic fibrous material, are typically fed to the inlet of a continuous digester using a separate feed system. The feed system typically includes equipment for de-aerating, heating, pressurizing, and introducing cooking liquor to the chips before transferring a slurry of chips and liquor to the digester. In the case of the hydraulic digester, this slurry of chips and liquor is introduced in a downward-directed screw-type conveyor at the top of the digester, known in the art as a "top separator".

The digester chip feed systems can be divided into two classes: Systems which have only atmospheric steaming to heat the chips and remove air from the chips, and systems which have both atmospheric and pressurized steaming. If there is only atmospheric steaming the temperature level at feed system is typically about 100° C. If there is also pressurized steaming, where the pressure is typically 0.7 to 1.5 bar higher than the atmospheric pressure, the temperature level is typically from 115 to 125° C. There is no additional heating between the feed system and the top of a single-vessel hydraulic digester and the temperature in the impregnation zone at the top is at the same level as in the feed system. Cooking temperature in the cooking zone is typically between 140° C. and 180° C. So there is a large temperature difference between the impregnation zone temperature at the top of the single-vessel hydraulic digester and the cooking zone. Due to the large temperature difference it can be difficult to heat the chips and liquor evenly by the cooking circulations. If the heating is not even some chips are not cooked as much as the others and the pulp quality is uneven and there can be a lot of uncooked material in the pulp. The bigger the temperature difference between the impregnation zone in the top and the cooking zone is the more difficult it is to reach an even heating result. Hot liquor density is lower than cold liquor density. If the density difference between the cooking zone hot liquors and impregnation zone cool liquors is too large, the hot liquor starts to channel to the top of the digester and cool liquors start to channel to the cooking zone causing severe disturbances for the cooking process. So it would be advantageous to be able to increase the impregnation zone temperature of the hydraulic digester, such as a single-vessel hydraulic digester, especially in the cases when there is only atmospheric steaming in the feed system and the temperature difference is high.

WO94/23120 describes a method in which steamed chips entrained in relatively cool liquor (at about 116° C.) are fed toward the top of a digester. The cool liquor is separated from the chips in a stand-alone separator/liquid exchanger (such as an inverted top separator) externally of the digester and replaced with hot cooking liquor (e.g. at 143° C.). The chips entrained in cooking liquor at cooking temperature are fed to the top of the digester. This process requires a free-standing liquid exchanger. Furthermore, it does not solve the problem caused by a high temperature difference in a single-vessel digester having an impregnation zone. A similar method is disclosed in U.S. Pat. No. 5,658,428, but the cool liquor is replaced with hot impregnation liquor in a liquid exchanger externally of the digester

SUMMARY OF INVENTION

An object of the new method is to provide an improved method for continuous cooking in a hydraulic digester, such as a single-vessel hydraulic digester, so that a suspension of chips can be evenly heated in the digester.

For achieving these objectives the present invention relates to a method of producing chemical pulp in an impregnation stage and a cooking stage, using a hydraulic digester having a top separator, a level of chips and a liquid phase above the level of chips, said method comprising the features of claim 1. The top separator is a solid/liquid separator at the top of the digester. It has a cylindrical screen surrounding a screw conveyor.

Surprisingly it has been found that direct steam can be fed safely to the liquor phase above the chip level at the top of the single-vessel hydraulic digester by using one or more steam injectors. In these injectors the steam flow is divided into small bubbles and the condensing of the small bubbles does not cause hammering or risks of breaking the hydraulically full cooking vessel.

In the new method direct steam is added to the liquor phase above the chip level at the top of the single-vessel hydraulic digester via one or more steam injectors to increase a temperature of the impregnation zone. A temperature increase can be from 1 to 40° C., preferably from 5 to 30° C. Temperature increase should be significant to achieve considerable benefits. On the other hand, too high an increase may not be good because it is more economical to heat with indirect steam in the liquor circulation heaters of the digester and collect the steam condensate than with direct steam. In addition, excessively high impregnation temperature might cause adverse effects on the pulp quality. It is especially advantageous to use the new method when there is no pressurized steaming stage or only a slightly pressurized steaming stage (the pressure below 0.5 bar (g)) in the chip feed system of the hydraulic digester and the temperature of the chip slurry is 110° C. or below. This means that the temperature of the impregnation zone would be less than about 110° C. without additional heating in accordance with the new method.

Steam is fed through a steam injector which is arranged in a wall of the top of the digester. The steam injector comprises a tube which extends to the interior of the digester and which is connected to a steam source located outside the digester. The length of the tube inside the digester is 150 -2500 millimeters (mm), typically 200-600 mm. The tube has a plurality of openings for discharging steam to the liquor phase above the chip level. Typically the openings are circular small holes having a diameter of 0.1-15 millimeters (mm), preferably 1.5-5.0 mm. The holes can be configured, typically, as circular holes, but also as gaps or slots. The term "hole" should therefore not be given any restrictive meaning, but should cover all through openings, slots, etc., regardless of shape.

The openings, typically hundreds of small holes, are distributed along the circumference and the length of the tube wall as a continuous zone or as separate zones. The separate zones may be disposed spaced apart along the length and circumference of the tube. The number of the holes depends on the steam flow required for heating the chip suspension, and thus the zone or zones can cover adequate portion(s) of the tube wall. Some portions of the tube wall may be unperforated. For instance, the tube end and/or the portion closest to the digester wall may be unperforated, whereas the portion therebetween is perforated partially or entirely.

There may be more than one tubes (injectors) disposed along the circumference of the digester wall so that the tubes may be equally or unequally spaced apart from each other. The distance between the tubes may depend e.g. on the construction of the top part of the digester.

According to one aspect of the new system the steam flow from steam openings may be directed radially and/or circumferentially in the digester. The steam flow along circumferential direction may intensify heat transfer in the liquid phase.

The discharge of steam through sufficiently small holes produces small bubbles. When condensing steam bubbles are small the vibration level will be significantly smaller and hammering is avoided.

DETAILED DESCRIPTION OF THE INVENTION

Figure 1:
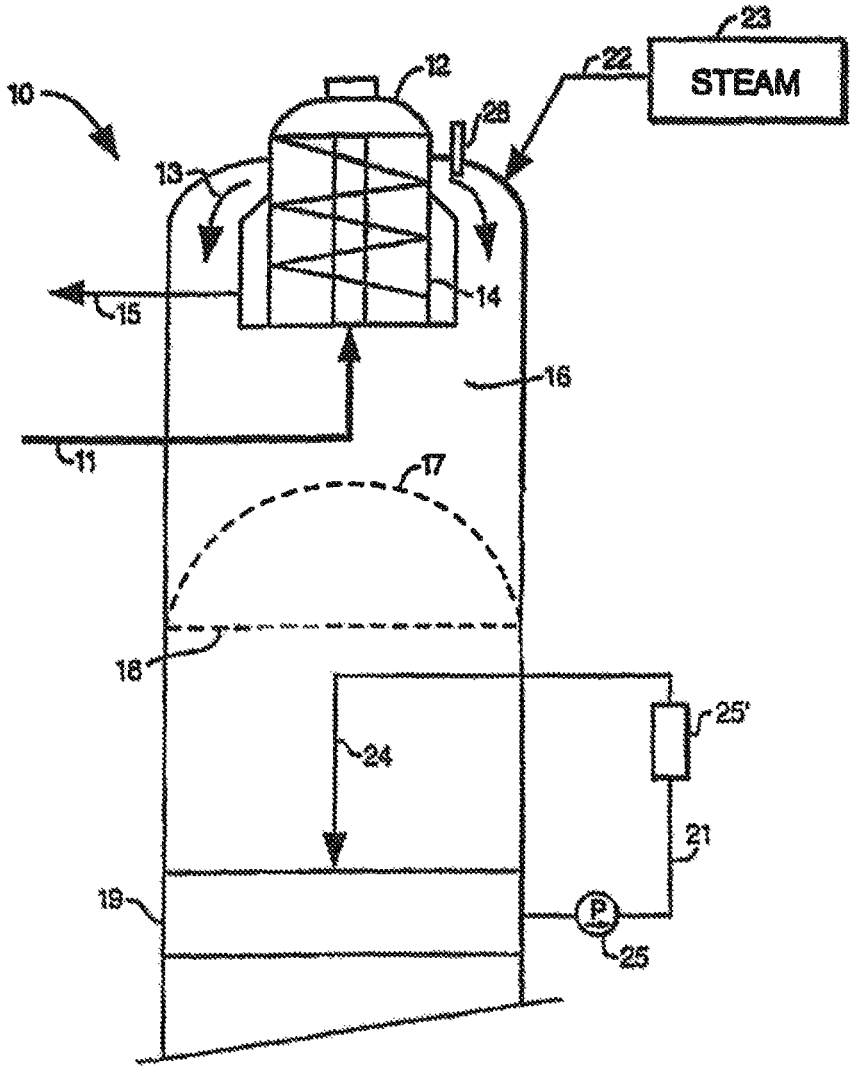
FIGS. 1 and 2 illustrate the top sections of two conventional continuous digesters. The top of a vapor-phase digester, 10, is shown in FIG. 1; a hydraulic digester, 20, is shown in FIG. 2.
Figure 2:
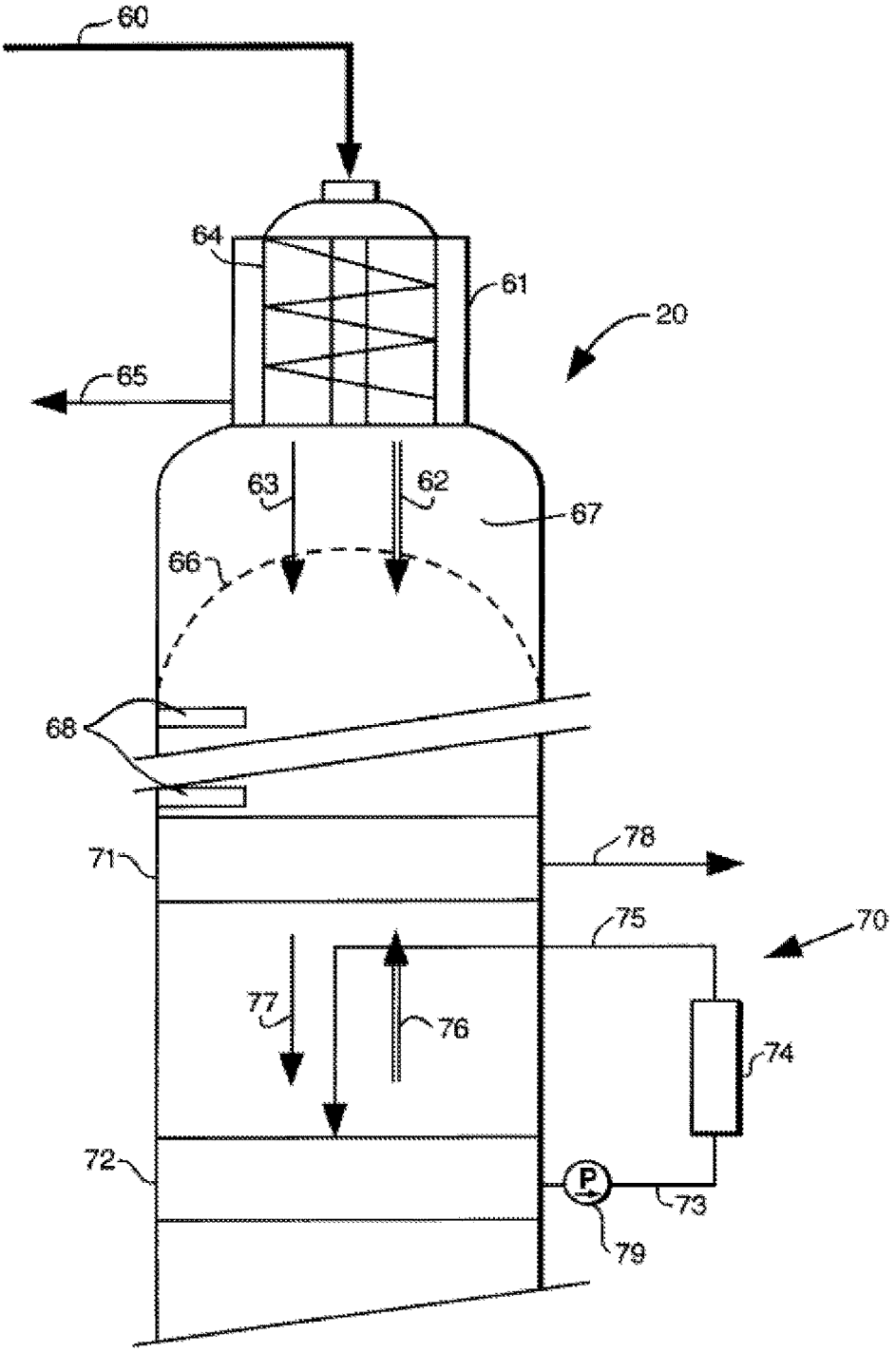

The digesters in FIGS. 1 and 2 typically receive a slurry of comminuted cellulosic fibrous material, typically wood chips, in cooking liquor, such as kraft white liquor. The slurry is typically first treated in a feed system. The vapor-phase digester of FIG. 1 is typically fed a slurry of chips and liquor in conduit 11. The slurry is introduced to the digester using a conventional vertically-oriented screw conveyor 12 known in the art as an "inverted top separator". The slurry is transported upwardly in the separator 12 and chips and liquor are discharged from the top of the separator 12 as shown by arrows 13. As the slurry is transported upwardly, excess liquor is removed from the slurry using a cylindrical screen 14 and returned to the feed system by way of conduit 15. The chips and liquor 13 discharged from separator 12 fall through a gas-filled zone 16 onto a chip pile 17. In order to continue the steam heating of the chips, the level of the chip pile 17 is maintained above the level of the cooking liquor 18, as seen in FIG. 1. After steam heating, the chips are immersed in cooking liquor, passing below the liquid level shown at 18 in FIG. 1, and the cooking processes continues. In order to improve the distribution of heat across the chip column and chip pile 17, a vapor-phase digester 10 typically also includes a liquor removal screen 19 and circulation 21, for drawing liquor radially outward, removing it and returning it via a centrally-located pipe 24 to the chip column. Circulation 21 typically includes a pump 25 and may include a liquor heater 25'. The liquor removal screen 19 and the associated circulation 21 (including pump 25 and pipe 24) are referred to in the art as the "trim circulation". Below the trim circulation screen 19, with a more uniform distribution of heat and chemical, the cooking process continues. Excess pressure, for ex-ample, pressure introduced by the gases introduced with the incoming chip slurry, is typically vented using a conventional pressure relief device, shown schematically at 28 in FIG. 1. The temperature in zone 16 is monitored and controlled by adding pressurized steam via conduit 22 from steam source 23.

Similar to the vapor phase digester 10 of FIG. 1, the conventional hydraulic digester 20 in FIG. 2 receives a slurry of chips and liquor from a feed system via conduit 60. The slurry is introduced to the digester 20 by a conventional "top separator" 61, which is a downwardly directed screw-conveyor. The liquor introduced by separator 61 is shown as a double arrow 62; the chips by single arrow 63. As the slurry is transported downwardly by conveyor 61, excess liquor is removed from the slurry through a cylindrical screen 64 and returned to the feed system (e.g. high pressure feeder) by conduit 65. The chips introduced by the separator 61 produce a level of chips 66. Since digester 20 is hydraulically full, the zone 67 above the chip level 66 is filled with liquid, so that no gaseous zone typically exists.

In FIG. 2 the chips on the top of pile 66 are typically not heated to full cooking temperature, but are treated in the impregnation zone where the temperature is typically at the same level as the temperature in the feed system. Then the chips must be heated before cooking commences. This is typically done utilizing one or more heated cooking circulation loops 70. Heating may be performed co-currently or counter-currently; the circulation loop 70 shown in FIG. 2 heats the chips counter-currently. The slurry first passes a liquor-removal (withdrawal) screen 71 which removes liquor from the slurry through conduit 78. Liquor removed via conduit 78 may be forwarded to chemical recovery. This liquor removal draws free liquor, shown by a double arrow 76, counter-currently past the downwardly flowing chips, shown by a single arrow 77. The heated liquor 76 is obtained from circulation 70. The liquor is first removed from the slurry via screen 72 via conduit 73 and a pump 79, heated in an indirect steam heater 74 (e.g. to a temperature of 140° C. to 170° C.), and returned to the vicinity of screen 72 by a centrally located return conduit 75. Cooking liquor, for example, kraft white liquor, is typically added to this circulation. After heating to cooking temperature in circulation 70, the slurry can be cooked and otherwise further treated below screen 72.

The temperature in the impregnation zone is typically 100-120° C. Cooking temperature in the cooking zone is typically between 140° C. and 180° C. So there is a large temperature difference between the impregnation zone temperature at the top of the single-vessel hydraulic digester and the cooking zone. Due to the large temperature difference it can be difficult to heat the chips and liquor evenly by the cooking circulations. If the heating is not even some chips are cooked less than the others and the pulp quality is uneven. This may result in a high amount of uncooked material in the pulp. The larger the temperature difference between the impregnation zone in the top and the cooking zone is the more difficult it is to reach an even heating result.

Figure 3:
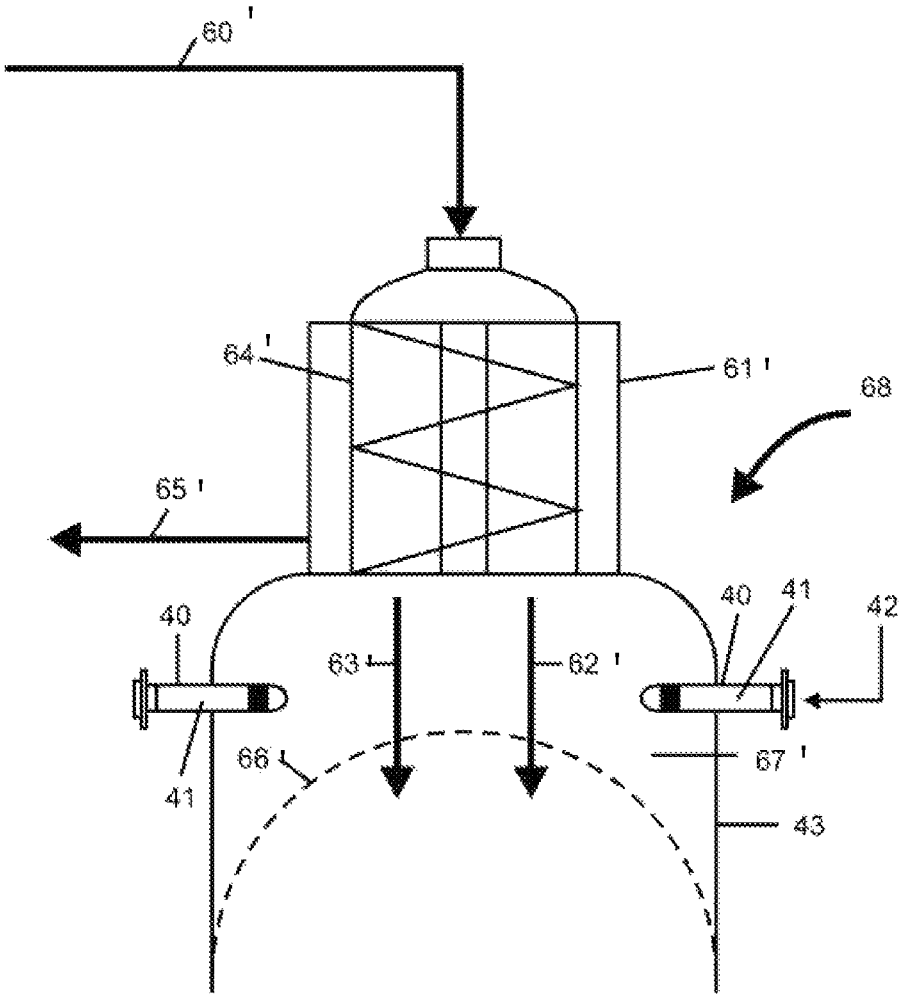
FIG. 3 is a view like that of FIGS. 1 and 2 of a typical inlet and upper section of a digester according to the present invention.

This can be solved by the new method presented herein. FIG. 3 illustrates the sys-tem which can be used to realize the new method.

Similar to FIG. 2, the conventional hydraulic digester 68 in FIG. 3 receives a slurry of chips and liquor from a feed system (not shown) via conduit 60'. The feed system may be unpressurized or slightly pressurized, and the temperature of the slurry is about 110° C. or below. The slurry is introduced to the digester 68 by a conventional "top separator" 61', which is a downwardly directed screw-conveyor. The liquor introduced by separator 61 is shown as an arrow 62'; the chips by an arrow 63'. As the slurry is transported downwardly by conveyor 61', excess liquor is removed from the slurry through a cylindrical screen 64' and returned to the feed system (e.g. high pressure feeder or pumps) by conduit 65. The chips introduced by the separator 61' produce a level of chips 66'. Since the digester 68 is hydraulically full, the zone 67', i.e. the liquid phase, above chip level 66' is filled with liquid, so that no gaseous zone typically exists.

The digester wall 43 having a continuously curved cross-section is provided with steam injectors 40, which comprise tubes 41 extending to the interior of the digester 68 through the wall. The tubes are connected to a steam source (not shown) for leading steam (arrow 42) to the digester. The length of the tube 41 inside the digester may be 150-2500 millimeters (mm), typically 200-600 mm. The tubes are located above the level of chips 66' and below the lower edge of the top separator 61' so that the steam is directed to the liquid phase 67'. The tubes are typically located 0.1-5.0 meters (m) below the top separator 61' in the vertical direction. When the steam is fed, a temperature increase can be from 1 to 40° C., preferably from 5 to 30° C.

Figure 4A:
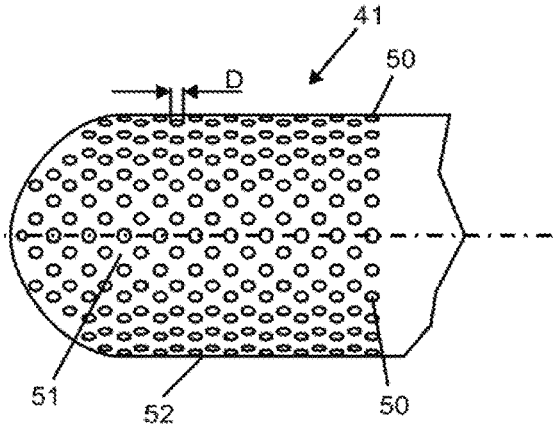
FIGS. 4*a* and 4*b* illustrate embodiments of a steam injector.
Figure 4B:
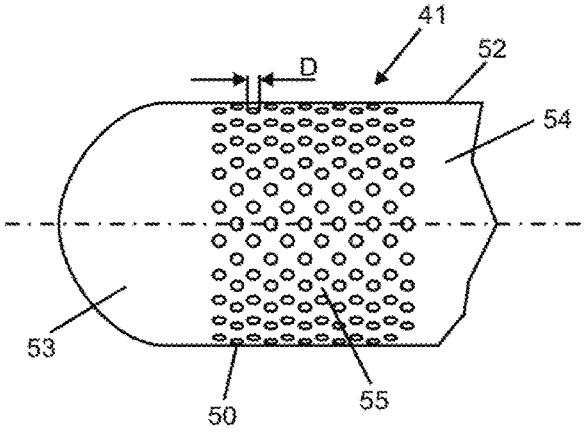

The tube 41 has a plurality of openings 50 (FIGS. 4*a* and 4*b*) for discharging steam to the liquor phase 67' above the chip level 66'. Typically the openings are circular small holes having a diameter (D) of 0.1-15 millimeters (mm), preferably 1.5-5.0 mm. The holes can be configured, typically, as circular holes, but also as gaps or slots. The term "hole" should therefore not be given any restrictive meaning, but should cover all through openings, slots, etc., regardless of shape.

The openings 50, typically hundreds of small holes, are distributed along the circumference and the length of the tube wall 52 as a continuous zone 51 or as separate zones. The separate zones may be disposed spaced apart along the length and/or circumference of the tube. The number of the holes 50 depends on the steam flow required for heating the chip suspension, and thus the zone or zones can cover adequate portion(s) of the tube wall. Some portions of the tube wall may be unperforated. For instance, the tube end 53 and/or the portion 54 closest to the digester wall may be unperforated, whereas the portion 55 therebetween is perforated partially or entirely.

Figure 5:
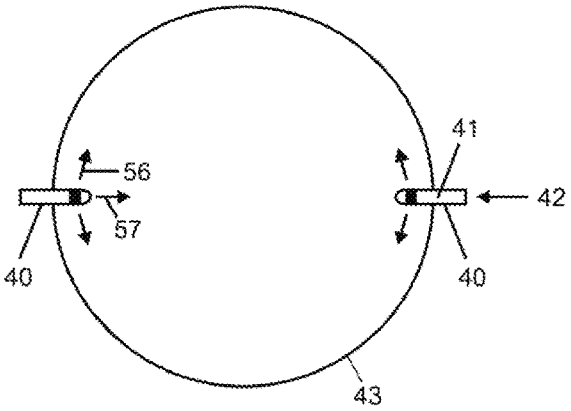
FIG. 5 illustrates locations of steam injectors in a wall of a digester.

FIG. 5 shows that there may be more than one injector 40 (tubes 41) disposed along the circumference of the digester wall 43 so that the tubes 41 may be equally or unequally spaced apart from each other. The distance between the tubes may depend e.g. on the construction of the top part of the digester.

As shown in FIG. 5, the steam flow from the steam openings 50 is directed radially (an arrow 57) and/or circumferentially (an arrow 56) in the digester. The steam flow along a circumferential direction may intensify heat transfer in the liquid phase. The direction of the steam flow may be defined by the location of the perforated and un-perforated zones in the tube wall.

It appears that adding direct steam via steam injectors solves the dominant problem regarding hydraulic digester operation. This problem has been too large a temperature difference between impregnation and cooking zones. All hydraulic digesters would benefit from the steam addition, especially those hydraulic digesters in which the impregnation zone temperature has been only about 100° C.

Although only some preferred embodiments of the method according to the invention have been described in the above, the invention covers all such modifications and variations that are included in the scope defined in the claims.

The invention claimed is:

1. A method of producing chemical pulp in an impregnation stage and a cooking stage, using a hydraulic digester, having a top separator, a level of chips and a liquid phase above the level of chips, comprising at least the following steps:

a. entraining chips in liquor to produce a slurry having a first temperature, b. feeding the slurry of chips to the digester through the top separator, c. supplying the direct steam to a liquid phase between the level of chips and the top separator to heat the slurry to a second temperature for the impregnation stage, wherein the steam is fed by using at least one steam injector having a plurality of steam discharge openings; and d. heating the slurry to a third temperature and cooking the chips in a cooking zone in the hydraulic digester, and withdrawing the cooked pulp from a bottom of the hydraulic digester.

2. The method according to claim 1, wherein the first temperature is below 110° C.

3. The method according to claim 1, wherein the second temperature is 1 to 40° C. higher than the first temperature.

4. The method according to claim 1, wherein the supplying of the direct steam includes feeding the direct steam through steam discharge openings having a diameter in a range of 0.1 to 15 mm to produce small bubbles in the liquid phase of the hydraulic digester.

5. The method of claim 1 wherein the step of supplying the direct steam includes heating the slurry to the second temperature while the slurry is in the liquid phase of the hydraulic digester.

6. The method of claim 1 wherein the at least one steam injector includes a conduit extending through an outer wall of the hydraulic digester and the plurality of steam discharge openings are in the liquid phase of the hydraulic digester.

* * * * *